United States Patent [19]

Crestin

[11] Patent Number: 4,732,567

[45] Date of Patent: Mar. 22, 1988

[54] APPARATUS AND METHOD FOR PREVENTING REVERSAL OF THE RELATIVE DISPLACEMENT BY HAND OF ENGAGED MALE AND FEMALE COMPONENTS

[75] Inventor: Joseph Crestin, Vanves, France

[73] Assignee: Societe d'Exploitation des Procedes Marechal (SEPM), S.A., Paris, France

[21] Appl. No.: 896,062

[22] Filed: Aug. 13, 1986

[30] Foreign Application Priority Data

Aug. 21, 1985 [FR] France ..... 85 12569

[51] Int. Cl.[4] ..... H01R 13/625

[52] U.S. Cl. ..... 439/332; 29/869

[58] Field of Search ..... 339/88 R, 90 R, 90 C, 339/111, 188 R, 188 C; 29/868, 869, 872; 439/314–319, 671–672, 332–337

[56] References Cited

U.S. PATENT DOCUMENTS

| | | | |
|---|---|---|---|
| 3,031,589 | 4/1962 | Noirclerc | 339/111 |
| 3,824,362 | 7/1984 | Bury | 200/153 J |
| 4,516,819 | 5/1985 | Magourou | 339/111 |
| 4,525,610 | 6/1985 | Magourou | 200/51.09 |
| 4,572,601 | 2/1986 | Jones et al. | 339/88 R |
| 4,632,481 | 12/1986 | Le Magourou | 339/11 |

FOREIGN PATENT DOCUMENTS

| | | |
|---|---|---|
| 0106931 | 5/1984 | European Pat. Off. . |
| 1213194 | 3/1966 | Fed. Rep. of Germany . |
| 1765720 | 9/1971 | Fed. Rep. of Germany . |
| 2531577 | 2/1984 | France . |
| 0441474 | 1/1968 | Switzerland . |

*Primary Examiner*—John McQuade

*Attorney, Agent, or Firm*—Sandler & Greenblum

[57] ABSTRACT

An apparatus and method for preventing a reversal in the relative displacement of male and female components when these components reach a particular position. One component is adapted to be displaced by hand relative to the other component in a first direction to couple the components and in a second direction opposite from the first direction to disengage the components. A support is rigidly attached to one of the components. A stud is mounted in the support to be displaceable away from an initial position in a direction perpendicular to the first direction. A guide ramp extending parallel to the first and second directions is positioned on the other component. The ramp has an abutment surface extending perpendicular to the first direction. One of the components is first displaced in the first direction, which causes a first surface of the ramp to displace the stud perpendicular to the first direction. Further displacement in the first direction disengages the stud from the first surface of the ramp and returns the stud to its initial position. Next, one of the components is displaced in the second direction causes the stud to move over a second surface of the ramp. Further displacement in the second direction causes the stud to abut the abutment surface, thereby preventing a reverse displacement of the components in the first direction.

32 Claims, 14 Drawing Figures

1A
1B
1C
1D
1E
1F 13a
13c
13
14
13b
10
11
P
31
12
F1
F2
X 17
18
10
19
16
15
11
Z

P
15
11
16
19
10

APPARATUS AND METHOD FOR PREVENTING REVERSAL OF THE RELATIVE DISPLACEMENT BY HAND OF ENGAGED MALE AND FEMALE COMPONENTS

BACKGROUND OF THE INVENTION

1. Field of the Invention

The invention relates to a system in which one of two interengaged components is adapted to be displaced with respect to the other component in one direction and then in another direction.

2. Description of Pertinent Information

Many systems exist in which two components are adapted to engage and disengage each other by displacing the components in a first direction and then in a second direction with respect to each other. In these systems it is often useful, necessary, or even essential that displacement in the second direction to disengage the components be permitted to take place only if one of the components has been displaced in the first direction to the maximum extent possible to engage the two components. This requirement may arise from the necessity to reset a spring, to operate a counter, or more often to restore at least one movable element to a position which enables it to perform its function during the following displacement in the second direction and to prevent any risk of damage to the moveable element.

This is the case in the electrical current supply connectors described in French Pat. No. 2,531,577, its first Certificate of Addition No. 85.04198, U.S. Pat. No. 4,516,819, and U.S. Ser. No. 732,294, as well as the current supply connector described in European Pat. No. 106,931 owned by Applicant and U.S. Pat. No. 4,525,610, all of the disclosures of which are hereby incorporated by reference thereto. In these connecting devices any return of the plug or plug socket to a closed position while the separation of the components is in progress would not only result in damage to the pivoting members which support the movable contacts, but would also likely initiate an electric arc between the pivoting members and the stationary contacts which would be particularly hazardous in a flammable or explosuve environment.

Thus, there is a need for an apparatus and method for preventing the displacement in the second direction of a moveable element during the separation of the components.

SUMMARY OF THE INVENTION

It is an object of the present invention to provide an apparatus and method for preventing the displacement in the second direction of an element of the components during the separation of the components in the first direction.

This object of the present invention is accomplished by one embodiment of the present invention which relates to an apparatus for preventing a reversal in the relative displacement of two components when the two components are positioned at a position beyond which a reversal in the relative displacement of the two components is undesirable. The two components comprise a male component and a female component. One of the components is adapted to be displaced by hand relative to the other of the components in a first direction and then in a second, reverse direction opposite from the first direction. The apparatus comprises a first element attached to one of the components and a second element attached to the other of the components. The first element is adapted to be displaced in a direction substantially perpendicular to the first direction. The second element is adapted to engage the first element. The second element extends substantially parallel to the first direction. The second element comprises an abutment surface extending substantially perpendicular to the first direction. The abutment surface comprises means for preventing a reversal in the direction of displacement of the first element at the position defined above.

In another embodiment the present invention relates to the apparatus described above in combination with the male and female components. The male and female components together comprise means for coupling the male and female components in response to displacement of the male and female components in the first direction and means for uncoupling the male and female components in response to displacement of the male and female components in the second direction.

In this embodiment the second element further comprises a first surface comprising: means for engaging the first element to displace the first element substantially perpendicular to the first direction in response to relative displacement of the components in the first direction; and means for disengaging from the first element after engaging the first element in response to sufficient displacement of the components in the first direction. In this embodiment the male and female components together comprise means for coupling with each other in response to relative displacement in the first direction of the male and female components by a distance sufficient for the first surface to engage and then disengage the stud.

The second element further comprises a second surface comprising means for engaging the first element after the first element has engaged and disengaged from the first surface and in response to relative displacement of the components in the second direction. Also, the abutment surface is on the second surface.

In one embodiment the second element comprises a substantially curvilinear lozenge-shaped element. In an alternative embodiment the second element comprises first and second spaced apart ribs. The first surface is on one of the ribs and the second surface is on the other of the ribs.

In another embodiment of the first element engages the abutment surface at the position noted above. In addition, the second element comprises means for displacing the first element substantially perpendicular to the first direction in response to relative displacement of the first and second components in the first direction. Also, the first element further comprises: a support rigidly attached to one of the components; and a stud mounted within the support so as to be displaceable substantially perpendicular to the first direction from an initial position.

The second element comprises means for displacing the stud in a direction substantially perpendicular to the first direction away from the initial position in response to relative displacement of the first and second components in the first direction. In addition, the first element further comprises means for biasing the stud against displacement out of its initial position.

The second element also comprises a first surface comprising the displacing means. In this embodiment the first surface comprises means for engaging the stud to displace the stud away from the initial position and for disengaging the stud in response to sufficient relative displacement between the components in the first direction, whereby the biasing means then returns the stud to its initial position.

In one embodiment this displacing means comprises a substantially curvilinear lozenge-shaped element comprising the first surface and a second surface. The second surface comprises means for displacing the lug in a direction opposite from the substantially perpendicular direction in response to relative displacement of the components in the second direction after relative displacement of the components has engaged and disengaged the first surface from the lug. This opposite direction is also substantially perpendicular to the first direction.

The abutment surface can be positioned on the second surface and extends substantially perpendicular to the first direction. The abutment surface comprises means for preventing displacement of the lug in the first direction after relative displacement of the components in the first direction has engaged and disengaged the first surface from the lug and after relative displacement of the components in the second direction has engaged the lug with the second surface and the abutment surface.

In one embodiment the invention relates to the apparatus defined above in combination with the male and female components. In this embodiment the male and female components together comprise means for coupling the male and female components in response to displacement of the male and female components in the first direction and means for uncoupling the male and female components in response to displacement of the male and female components in the second direction. The male and female components together comprise means for coupling with each other in response to relative displacement in the first direction of the male and female components sufficient for the first surface to engage and then disengage the stud. In one embodiment this relative displacement comprises rotation of the male and female components with respect to each other. In an alternative embodiment this relative displacement comprises rectilinear displacement of the male and female components with respect to each other.

In still another embodiment the apparatus comprises: a support rigidly fixed to one of the components; and a stud mounted within the support so as to be displaceable in a plane substantially perpendicular to the first direction and the second direction. The first element can also further comprises in this embodiment means for biasing the first element into an initial rest position, wherein the biasing means comprises a resilient element. Also, the second element can comprises a stud guiding ramp extending in a direction substantially parallel to the first direction. Also the ramp comprises the abutment surface and the stud is positioned opposite from the abutment surface at the position defined above.

In one embodiment the support comprises a cylindrical casing comprising: an end wall and a casing cover. The end wall comprises an internal face and a diametral slot therein, and the casing cover comprises an internal wall. In this embodiment the stud comprises a metal rod extending through the slot and a flat head. The flat head abuts the internal wall of the casing cover when the stud is in the rest position. Also, the biasing means comprises a conical coil spring positioned between the flat head and the internal face of the end wall.

In addition, the stud guiding ramp comprises a lug projecting from one of the components. The projecting lug has the general shape of a curvilinear lozenge. The major diagonal of the lozenge is substantially parallel to the first direction. The ends of the major diagonal delimit first and second half-perimeters. The stud follows the first half-perimeter in response to relative displacement of the components in the first direction. In addition, the stud follows the second half-perimeter in response to relative displacement of the components in the second direction. At least one of the half-perimeters comprises the abutment surface, and the abutment surface comprises a catch recess having a steep face in at least one of the half-perimeters.

In another embodiment the stud guding ramp comprises spaced apart first and second ribs. The stud engages the first rib before engaging the second rib in response to relative displacement of the components in the first direction. In addition the first rib is slightly inclined with respect to the first and second directions. The first rib is sufficiently inclined with respect to the first and second directions so as to displace the stud away from the second rib in response to relative displacement of the components in the first direction. The second rib extends substantially in the direction of the first and second directions, and the second rib comprises an end closest to the first rib. One end of the second rib comprises the abutment surface and the spacing of the first and second ribs at their nearest point is greater than the diameter of the stud.

Each rib is parallelepipedal is shape and comprises a proximal end face facing the other rib. The proximal end faces of the ribs are laterally offset with respect to each other. In addition the first and second ribs each comprises a lateral face having an end. Also, the first rib comprises: means for engaging the stud wit the lateral face of the first rib, thereby displacing the stud substantially perpendicular to the first direction away from the initial rest position in response to relative displacement of the components toward each other; and means for displacing the stud beyond the end of the lateral face of the first rib so as to disengaging the lateral face from the stud in response to further relative displacement of the components is the first direction. In addition, the biasing means comprises means for displacing the stud into contact with the lateral face of the second rib after the stud is displaced beyond the end of the lateral face of the first rib.

The second rib comprises: an end face facing the first direction; means for engaging the lateral face of the second rib with the stud in response to relative displacement of the components in the second direction; and means for displacing the stud beyond the end of the lateral face of the second rib so as to disengage the lateral face of the second rib from the stud in response to further relative displacement of the components in the second direction. In this embodiment the biasing means comprises means for displacing the stud to face the end face of the second rib after the stud is displaced beyond the end of the lateral face of the second rib so that relative displacement of said components in said first direction would cause said stud to abut said end face.

In still another embodiment the invention comprises the apparatus discussed above in combination with an electric current supply connector. The electric current supply connector comprises a male plug component comprising the male component and a female socket component comprising the female component. The male and female components comprise contacts adapted to engage each other when the connector is closed and adapted to open and disengage from each other when the connector is opened. The connector is adapted to be closed by a closing movement in the first direction so that the male and female components engage one another by relative translational and/or rotational displacement of the components. In addition, the connector is adapted to be opened to separate the male and female components and to disengage and open the contacts from each other by relative displacement of the components in the second direction. In this embodiment the apparatus comprises means for preventing displacement of the components in the first direction when the components are displaced relative to one another in the second direction a sufficient distance to open the contacts.

The invention also relates to a method of connecting and disconnecting two components comprising the steps of: (a) displacing two components with respect to each other in a first direction; (b) displacing a first element attached to one of the components in a direction substantially perpendicular to the first direction away from an initial rest position with a second element attached to the second comonent and extending substantially parallel to the first direction as a result of the further relative displacement of the two components in the first direction; (c) displacing the first element back toward its initial rest position as a result of the relative displacement of components in the first direction beyond the position of the components in step (b); (d) displacing the two components with respect to each other in a second direction opposite from the first direction; and (e) preventing the displacement of the two components in the first direction after the two components are displaced in the second direction by a distance sufficient for an abutment surface on the second element to prevent displacement of the first element in the first direction.

In addition, step (e) can further comprise the step of positioning the first element into contact with the abutment surface. In this embodiment the abutment surface extends substantially perpendicular to the first direction.

In addition, the two components comprises a male component and a female component, and the method further comprises the steps of: engaging the male and female components before step (a) by displacing the components in the first direction; and completely coupling the male and female components with each other between steps (c) and (d).

In still another embodiment the invention relates to a method of connecting and disconnecting a male plug component and a female component socket component of an electric current supply connector. The components comprise electrical contacts adapted to engage each other when the components are displaced in a first direction and adapted to disengage from each other when the components are displaced by a sufficient distance in a second direction. The method comprises the step of: (a) engaging the male and female components and the electrical contacts by displacing the components in the first direction; (b) displacing a first element attached to one of the components in a direction substantially perpendicular to the first direction away from an initial rest position with a second element attached to the second component and extending substantially parallel to the first direction as a result of the further relative displacement of the two components in the first direction; (c) displacing the first element back toward the initial rest position as a result of the relative displacement of components in the first direction beyond the position of the components in step (b); (d) displacing the two components with respect to ecah other in the second direction opposite from the first direction; and (e) preventing the displacement of the components in the first direction when the components are displaced relative to one another in the second direction a sufficient distance to open the contacts.

BRIEF DESCRIPTION OF THE DRAWINGS

The present invention will be more readily understood by referring to the detailed descriptin which follows in conjunction with the attached drawings in which.

DETAILED DESCRIPTION OF PREFERRED EMBODIMENTS

The present invention is designed to prevent any return of the plug and plug socket to their closed position in a current supply connector while the separating of the male plug component and the female socket component is in progress, thereby preventing damage to pivoting members supporting the movable contacts in the connector and preventing the generation of an electric arc between the pivoting members and the stationary contacts. In addition, the present invention is applicable to other mechanical or electrical systems.

The present invention is also designed to ensure that the relative displacement of two engageable components of other mechanical or electrical systems on the outward or return path takes place only if the preceding relative displacement of the components has taken place to the maximum extent possible in a particular direction.

To achieve these goals the present invention provides a device for ensuring total freedom in the relative displacement of two components comprising male and female components. One component is adapted to be displaced relative to the other component by hand in a first direction and then in a second, opposite direction while at the same time preventing any backward displacement or return of the component beyond a predetermined point in its path of travel during displacement in at least one of the two directions defined above.

The apparatus comprises a support rigidly attached to one of the components and a stud mounted within the support. The stud is adapted to be displaced in a plane substantially perpendicular to the general direction of relative displacement of the components. In addition the stud is biased into an intermediate rest position by a resilient elastic element. The apparatus also comprises a stud-guiding ramp positioned on the other component. The ramp extends substantially parallel to the general direction of relative displacement of the components. The ramp comprises an abutment surface positioned at one point on the ramp. The abutment surface is substantially perpendicular to the direction of displacement of the components. The stud and ramp are so positioned on the two components that the stud is located opposite from the abutment surface at the instant the relative displacement of the components reaches the position beyond which a reversal in the direction of the relative displacement of the two components is to be prevented.

The stud comprises a metal rod which extends through a diametral slot in an end wall of a cylindrical casing of the support. The stud further comprises a flat heat which contacts, in the rest position of the stud, the internal face of a casing cover which covers the casing. A conical spring which comprises the resilient member is positioned between the flat head and the internal face of the casing cover.

Figure 1:
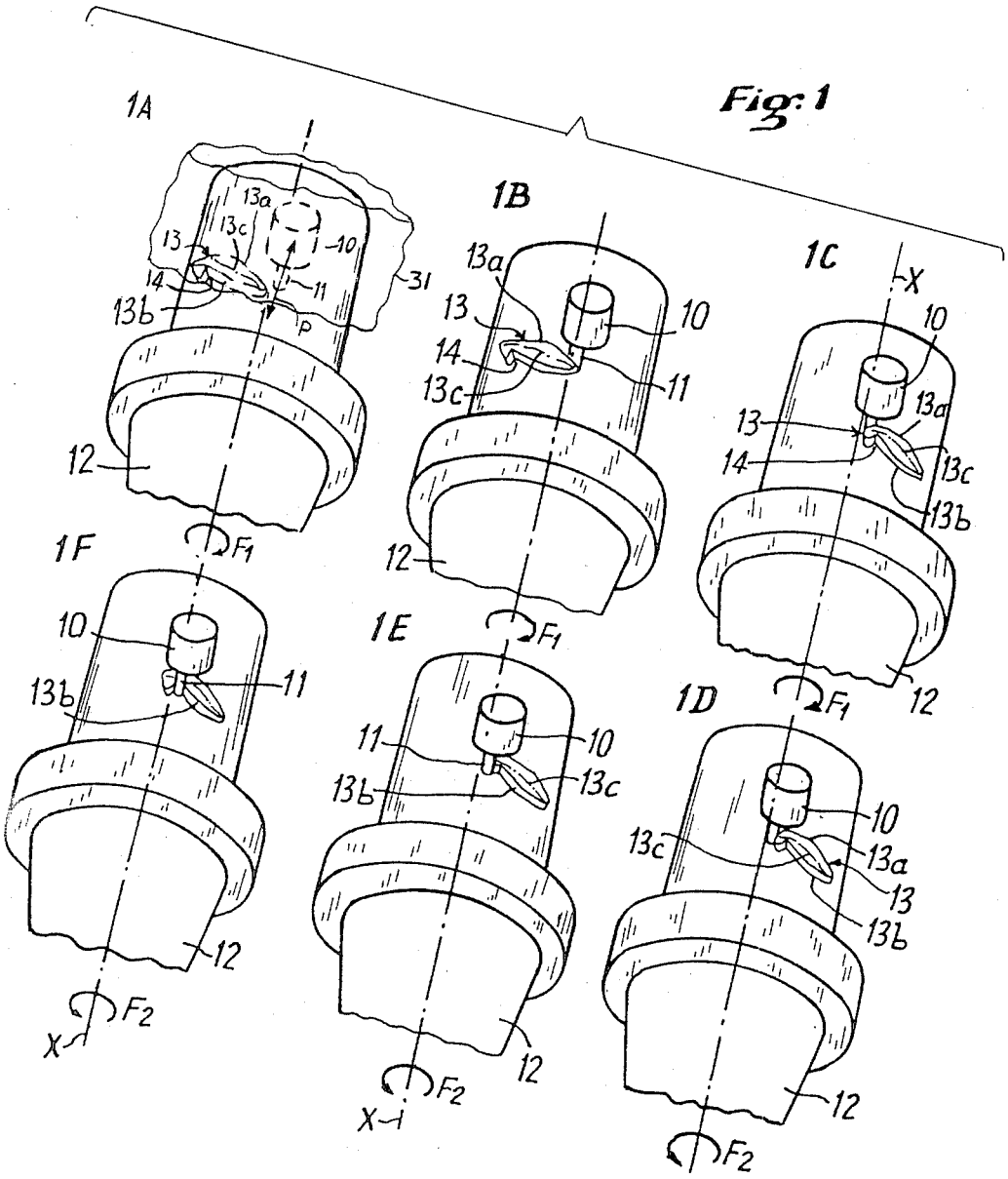
FIGS. 1*a*–1*f* illustrate six schematic, perspective views of the successive relative positions of a stud and a guide ramp of the present invention, wherein these two elements are attached, respectively, to female and male components in which the final stage of coupling of the these components occurs in response to the relative rotational displacement of these components.

As illustrated schematically in FIG. 1 the apparatus of the present invention comprises a stud 11 and a stud guiding ramp 13. These elements are adapted to be applied to two components that are adapted to engage each other. For example, in the embodiment illustrated in FIG. 1 stud 11 is attached to a female member 31, as illustrated in FIG. 1A. The female member is illustrated only in FIG. 1A for simplicity. Female component 10 is attached to female member 31. The female component is not actually a female member, but is called a female component because it is attached to the female member. Ramp 13 is attached to a male component 12. However, it is within the scope of the present invention for the stud to be attached to the male component and for the ramp to be attached to the female component.

As illustrated in FIGS. 1A–1F the final stage of the coupling of male component 12 and female component 10 is accomplished by the rotation of male component 12 about the X axis of male component 12.

Stud 11 is adapted to be displaced substantially in a plane P which passes through axis X. In other words, stud 11 is adapted to be displaced in a plane substantially perpendicular to the general direction of relative displacement of male component 12 with respect to female component 10.

Male component 12 is adapted to support a projecting lug 13 in the form of a double guide ramp. Lug 13 is adapted to engage and guide displaceable stud 11 as will be explained below. Lug 13 has the general shape of a curvilinear lozenge. The ends of a major diagonal **13*c* passing through the lozenge delimit two half-perimeters 13*a* and 13*b* of the lug. Stud 11 is displaced by and follows the path of half-perimeter 13*a* during a portion of the relative displacement of male component 12 and female component 10 in direction $F_1$. Stud 11 is also dislaced by and follows the path of half-perimeter 13*b* during a portion of the relative displacement of male component 12 and female component 10 in the direction $F_2$, which is opposite from direction $F_1$. Half-perimeter 13*b* of lug 13 comprises a recess 14 having the shape of a hook tooth or catch with a steep face. This face of recess 14 is sufficiently steep, is of sufficient size, and has an orientation sufficient to prevent the displacement of stud 11 in direction $F_1$ when stud 11 abuts the steep face of recess 14. In the embodiment illustrated in FIGS. 1A–1F the plane passing through the steep face of recess 14** is substantially parallel to axis X, and therefore substantially perpendicular to direction $F_2$.

Figure 3:
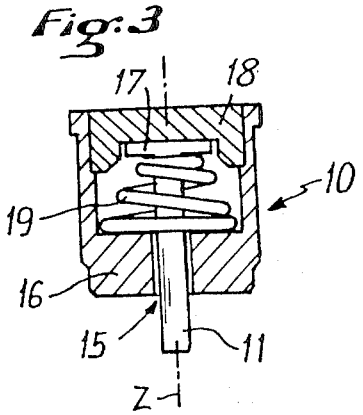
FIG. 3 illustrates an enlarged, cross-sectional view of the stud, its casing and its support which are attached to the female component.
Figure 4:
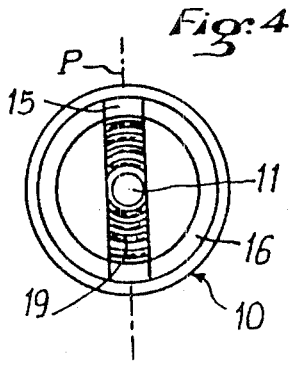
FIG. 4 illustrates an enlarged bottom view of the stud, its casing and its support, which are attached to the female component.

The manner in which stud 11 is mounted in its casing 10 is illustrated in FIGS. 3 and 4. Casing 10 is cylindrical in shape and comprises an end wall 16 having a diametral slot 15 therein and an internal face. Also provided is a casing cover 18 for casing 10 which also comprises an internal face. Stud 11 comprises a metal rod which extends through diametral slot 15. Stud 11 also comprises a flat head 17 which, in an initial rest position of stud 11, abuts the internal face of casing cover 18. A conical spring 19 is positioned between flat head 17 and the internal face of end wall 16. As a result of this structure stud 11 is adapted to be pivotally displaced away from an initial rest position of stud 11 in the center of slot 15. In the initial rest position of stud 11 the Z axis of longitudinal symmetry of casing 10 extends throught the longitudinal axis of symmetry of stud 11. This pivoting of stud 11 away from its rest position occurs in a diametral plane P of casing 10 passing through diametral slot 15. In addition, when stud 11 pivots in slot 15 away from its rest position, stud 11 deforms spring 19 which biases stud 11 back into its rest position.

The operation of the appartus will now be explained. When male component 12 is engaged within female component 10 coupling of these components is effected by the relative rotation of male component 12 and female component 10 in direction $F_1$. In the embodiment illustrated male component 12 is manually rotated in direction $F_1$. After complete engagement of the male and female components studs 11 is positioned opposite from a poit at one end of half-perimeter **13*a* of lug 13 as is illustrated in FIG. 1A. When male component 12 is rotated in direction $F_1$ stud 11 contacts one end of half-perimeter 13*a* as is shown in FIG. 1B and is thrust away from component 12 and away from its initial rest position in a direction substantially perpendicular to direction $F_1$. This occurs because half-perimeter 13*a* acts as a guide ramp which causes stud 11 to slide on half-perimeter 13*a*. This sliding of stud 11 on half-perimeter continues, as is illustrated in FIG. 1C, in response to continued rotation of male component 12 in direction $F_1$ until stud 11 reaches the other end of half-perimeter 13*a*, as is illustrated in FIG. 1D. At this point the coupling of male component 12 and female component 10 is complete and stud 11 is positioned either at the end of the major diagonal of lug 13, as illustrated in FIG. 1D, or slightly beyond this major diagonal out of engagement with half perimeter 13*a*. Once stud 11 has reached the position illustrated in FIG. 1D, half-perimeter 13*a* no longer acts against the bias of spring 19 so that spring 19 displaces stud 11 back into its initial rest position. When this occurs stud 11 is positioned opposite from a point on one end of half-perimeter 13*b***.

In order to disengage and uncouple male component 12 and female component 10, male component 12 is now manually rotated in direction $F_2$ opposite from direction $F_1$. In response to rotation of male component 12 in direction $F_2$, stud 11 contacts and slides over half-perimeter **13*b*. The curvature of half-perimeter 13*b* is such that stud 11 is thrust back in a direction opposite from the direction in which the male and female components must be displaced for the engagement of these components, as is illustrated in FIG. 1E**.

Catch recess 14 is positioned at the point on half-perimeter 13*b* at which it is desired to prevent any reversal in the relative rotation of the components. The steep face of catch recess 14 comprises an abutment surface which extends substantially parallel to the X axis. As a result of the bias of spring 19, after stud 11 is thrust back in the direction opposite from the direction in which the male and female components must be displaced for engagement of these components, stud 11 engages recess 14 as is illustrated in FIG. 1F, thereby preventing the relative displacement of the components in direction $F_1$. As the rotation of male component 12 in direction $F_2$ continues stud 11 slides over the entire half-perimeter 13*b* until stud 11 reaches the other end of half-perimeter 13*b* and disengages from perimeter 13*b* to return to the initial position illustrated in FIG. 1A.

In the embodiment illustrated in FIG. 1 only the rotation in direction $F_2$ can be reversed, but it is within the scope of the present invention for catch 14 to be formed on half-perimeter 13*a* in order to prevent any reversal in the rotation of the components in direction $F_1$. Alternatively, a recess can be formed on each half-perimeter 13*a* and 13*b* so as to prevent a reveral in the rotation of the components when the components are being coupled by rotation in direction $F_1$ and so as to preent a reversal in the rotation of the components when the components are being uncoupled and separated by rotation in direction $F_2$.

It should also be noted that although in the embodiment illustrated in FIG. 1 rotation of male component 12 in directions $F_1$ and $F_2$ occurs without any axial displacement, it is also within the scope of the present invention to use male and female components that are coupled and uncoupled by means of a relative helical displacement of these components. In this alternative embodiment major diagonal 13*c* of lug 13 extends in a helix, and the angular orientation of casing 10 is modified so that slot 15 extends in a plane substantially perpendicular to this helix of major diagonal 13*c*.

Figure 2:
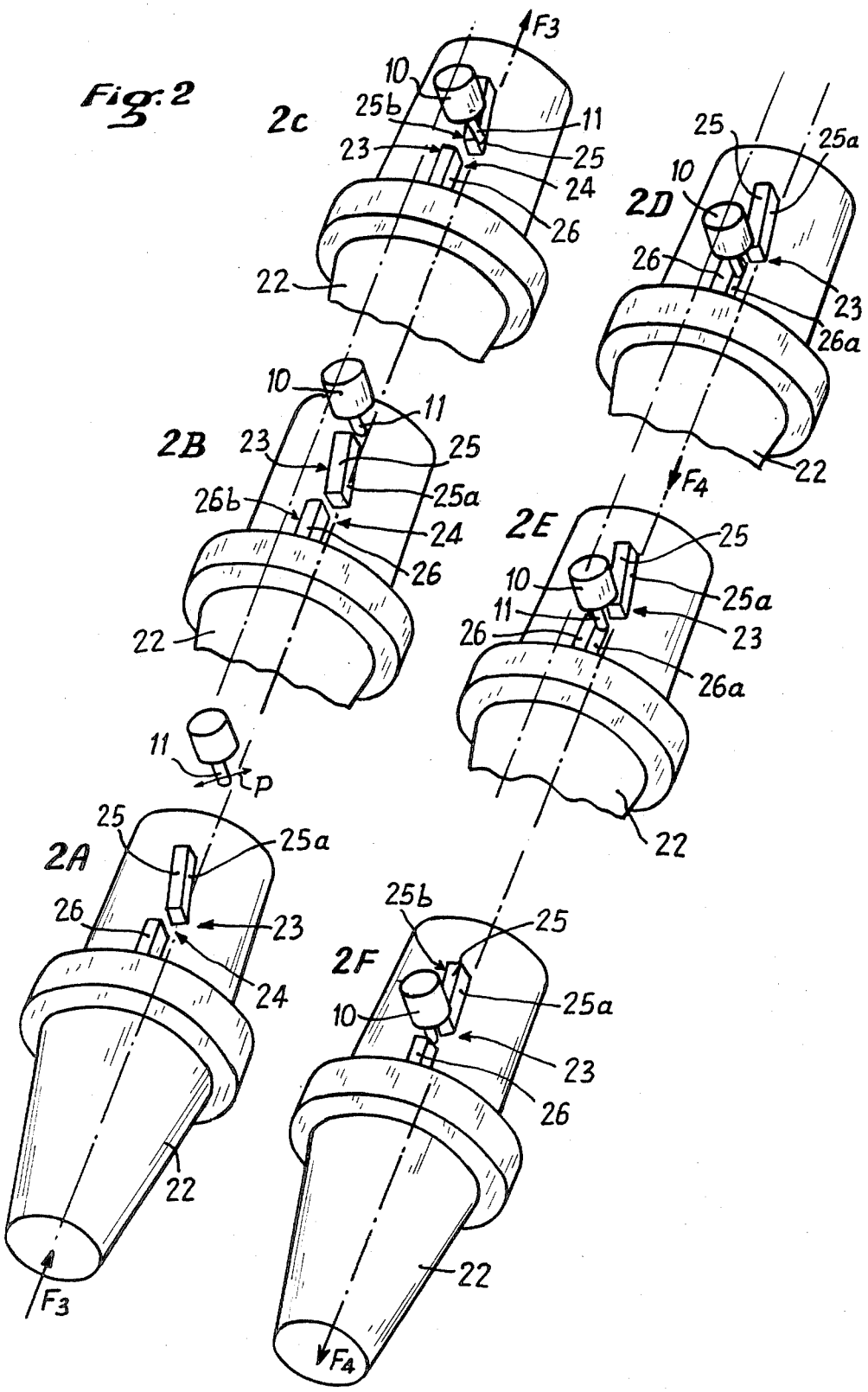
FIGS. 2*a*–2*f* illustrate six schematic, perspectiv views of the successive positions of a stud and guide ramp of the present invention, wherein these two elements are attached, respectively, to female and male components which are coupled together in response to relative axial translational displacement of these components.

Unlike the embodiment illustrated in FIG. 1 in which coupling and uncoupling of the components occurs by relative rotation of the components, the embodiment illustrated in FIG. 2 couples and uncouples the components by means of relative axial translational displacement of the components. In the embodiment illustrated in FIG. 2 this occurs by the manual displacement of the male component in directions $F_3$ and $F_4$. More specifically, FIGS. 2A–2F show a male component 22 adapted to engage and couple with a female component 10 by rectilinear displacement of male component 22 in direction $F_3$. As in the embodiment illustrated in FIG. 1, this embodiment uses a displaceable stud 11 housed within a casing 10 as illustrated in FIGS. 3 and 4. In addition, in this embodiment casing 10 also schematically represents the female component. As a result, stud 11 is adapted to be pivotally displaced in plane P at substantially a right angle to direction $F_3$ and $F_4$.

In this embodiment the stud guiding ramp 23 supported by the male component is in the form of two spaced apart, oblong, parallelepipedal ribs 25 and 26. Rib 25, which engages stud 11 before rib 26 engages stud 11 when the components are being coupled by displacement in direction $F_3$, extends slightly obliquely with respect to direction $F_3$ and with respect to the directions in which the components are displaced to couple and uncouple the components. Rib 26, on the other hand, is substantially parallel to direction $F_3$ and the directions in which the components are displaced to couple and uncouple the components. Each rib comprises a proximal end face. The proximal end faces of the ribs are spaced apart from each other in the lateral direction, and in the longitudinal direction as indicated at 24. The proximal end faces of the ribs are spaced apart from each other in the longitudinal direction by a distance greater than the diameter of stud 11.

The operation of the apparatus will be explained. Before the male and female components engage each other stud 11 is in its initial, rest position opposite from a point on one end of a lateral face 25*a* of rib 25, as is illustrated in FIG. 2A. Because rib 25 extnds obliquely to direction $F_3$, stud 11 is displaced away from its initial rest position and away from rib 26 in a direction substantially perpendicular to direction $F_3$ as stud 11 slides over lateral face 25*a* of rib 25 in response to the relative displacement of the male and female components in direction $F_3$. This is illustrated in FIG. 2B. Relative displacement of the components continues in direction $F_3$ until stud 11 arrives at the other end of lateral face 25*a* of rib 25, as is illustrated in FIG. 2C. At this point because rib 25 no longer opposes displacement of stud 11 back into its initial, rest position, the bias of spring 19 displaces stud 25 back in the direction of its initial rest position. However, stud 11 does not yet return to this initial, rest position because stud 11 first contacts a lateral face 26*a* of rib 26, as is illustrated in FIG. 2D. At this point the male and female elements are completely coupled with each other.

In order to separate and uncouple the male and female components, male component 22 is translationally displaced in direction $F_4$, which is opposite from direction $F_3$. Displacement of male component 22 in direction $F_4$ causes stud 11 to slide over lateral face 26*a* of rib 26 as illustrated in FIG. 2E. Lateral face 26*a* of rib 26 extends substantially parallel to directions $F_3$ and $F_4$. When stud 11 reaches the end of lateral face 26*a* of rib 26 stud 11 returns to its initial, rest position in the diametral plane of the two components and is positioned opposite an end face of rib 26 which extends substantially perpendicular to directions $F_3$ and $F_4$, as is illustrated in FIG. 2F. As a result, any displacement of male component 22 in direction $F_4$ to again couple the components will be prevented by contact between stud 11 and the end face of rib 26. Consequently, end face 26 of rib 26 comprises an abutment surface which prevents any translational displacement of the components in direction $F_3$. The length of rib 26 is chosen so that stud 11 arrives its position in FIG. 2F at the point at which it is desirable to prevent any reversal in the displacement of the components. From the position of the components illustrated in FIG. 2F, male component 22 continues its displacement in direction $F_4$, which causes stud 11 to slide over a lateral face 25*b* of rib 25, thereby again displacing stud 11 away from its initial, rest position, but in a direction opposite from the direction in which stud 11 was displaced when sliding over lateral face 25*a*. Displacement of male component 22 continues in direction $F_4$ until stud 11 arrives at the opposite end of rib 25 at which point stud 11, due to the bias of spring 19, returns to its initial, rest position. In this position, illustrated in FIG. 2A, the two components are again uncoupled.

It should be understood that the invention is not limited to the two embodiments described above, (e.g. the guide ramp comprises either a single element having catch recess or two spaced apart ribs), which are given solely by way of example. It is within the scope of the invention to use other types of elements besides studs and ramps, and these elements can be used on interengaging components, regardless of the type of displacement that is needed to engage and disengage the components. For example, the guide ramp having a recess illustrated in FIG. 1 can be adapted for use with components that are coupled and uncoupled by axial translational displacement, just as the two ribs illustrated in FIG. 2 can be used with components that are adapted to be engaged and disengaged by relative rotational movement.

As noted above, the present invention an be advantageously used with electrical current supply connectors. In this type of application the invention comprises means for preventing the re-closing of the connector when the separating of the components reaches the point at which the electrical contact in the connector are disengaged or open, i.e. the position illustrated in FIGS. 1F and 2F. In this instance, the separation of the components must be completed before the components can be returned to a position in which coupling becomes possible (i.e. the position illustrated in FIGS. 1A and 2A).

Although the invention has been described with respect to particular means, methods, and embodiments, the invention is not limited thereto, but extends to all equivalents within the scope of the claims.

What is claimed is:

1. An apparatus for preventing a reversal in the relative displacement of two components when said two components are positioned at a position beyond which a reversal in the relative displacement of said two components is undesirable, wherein said two components comprise a male component and a female component, wherein one of said components is adapted to be displaced by hand relative to the other of said components in a first direction and then in a second, reverse direction opposite from said first direction, wherein said apparatus comprises:

(a) a first element attached to one of said components, wherin said first element is adapted to be displaced in a direction substantially perpendicular to said first direction; and (b) a second element attached to the other of said components, wherein said second element is adapted to engage said first element, wherein said second element extends substantially parallel to said first direction, wherein said second element comprises an abutment surface extending substantially perpendicular to said first direction, wherein said abutment surface comprises means for preventing a reversal in the direction of displacement of said first element at said position.

2. The apparatus defined by claim 1 in combination with said male and female components, wherein said male and female components together comprise means for coupling said male and female components in response to displacement of said male and female components in said first direction and means for uncouplng said male and female components in response to displacement of said male and female components in said second direction.

3. The apparatus defined by claim 2 wherein said second element further comprises a first surface comprising:

means for engaging said first element to displace said first element substantially perpendicular to said first direction in response to relative displacement of said components in said first direction; and means for disengaging from said first element after engaging said first element in response to sufficient displacement of said components in said first direction, wherein said male and female components together comprise means for coupling with each other in response to relative displacement in said first direction of said male and female components by a distance sufficient for said first surface to engage and then disengage said first element.

4. The appartus defined by claim 3 wherein said second element further comprises a second surface comprising means for engaging said first element after said first element has engaged and disengaged from said first surface and in response to relative displacement of said components in said second direction, wherein said abutment surface is on said second surface.

5. The apparatus defined by claim 4 wherein said second element comprises a substantially curvilinear lozenge-shaped element.

6. The apparatus defined by claim 4 wherein said second element comprises first and second spaced apart ribs, wherein said first surface is on said first rib, wherein said second surface is on said second rib.

7. The apparatus defined by claim 1 wherein said first element engages said abutment surface at said position.

8. The apparatus defined by claim 7 wherein said second element comprises means for displacing said first element substantially perpendicular to said first direction in response to relative displacement of said first and second components in said first direction.

9. The apparatus defined by claim 8 wherein said first element further comprises:

a support rigidly attached to one of said components; and a stud mounted within said support so as to be displaceable substantially perpendicular to said first direction from an initial position.

10. The apparatus defined by claim 9 wherein said second element comprises means for displacing said stud in a direction substantially perpendicular to said first direction away from said initial position in response to relative displacement of said first and second components in said first direction, wherein said first element further comprises:

means for biasing said stud against displacement out of said initial position.

11. The apparatus defined by claim 10 wherein said second element comprises a first surface comprising said displacing means, wherein said first surface comprises means for engaging said stud to displace said stud away from said initial position and for disengaging said stud away in response to sufficient relative displacement between said components in said first direction, whereby said biasing means then returns said stud toward said initial position.

12. The apparatus defined by claim 11 wherein said displacing means comprises a substantially curvilinear lozenge-shaped element comprising said first surface and a second surface, wherein said second surface comprises means for displacing said stud in a direction opposite from said substantially perpendicular direction in response to relative displacement of said components in said second direction after relative displacement of said components has engaged and disengaged said first surface from said stud, wherein said opposite direction is also substantially perpendicular to said first direction.

13. The apparatus defined by claim 12 wherein said abutment surface is positioned on said second surface and extends substantially perpendicular to said first direction, wherein said abutment surfaces comprises means for preventing displacement of said stud in said first direction after relative displacement of said components in said first direction has engaged and disengaged said first surface from said stud and after relative displacement of said components in said second direction has engaged said stud with said second surface and said abutment surface.

14. The apparatus defined by claim 13 in combination with said male and female components, wherein said male and female components together comprise means for coupling said male and female components in response to displacement of said male and female components in said first direction and means for uncoupling said male and female components in response to displacement of said male and female components in said second direction.

15. The apparatus defined by claim 14 wherein said male and female components together comprise means for coupling with each other in response to relative displacement in said first direction of said male and female components sufficient for said first surface to engage and then disengage said stud.

16. The apparatus defined by claim 15 wherein said relative displacement comprises rotation of said male and female components with respect to each other.

17. The apparatus defined by claim 15 wherein said relative displacement comprises rectilinear displacement of said male and female components with respect to each other.

18. The apparatus defined by claim 1 wherein said first element comprises:

a support rigidly fixed to one of said components; and a stud mounted within said support so as to be displaceable in a plane substantially perpendicular to said first direction and the second direction.

19. The apparatus defined by claim 18 wherein said first element further comprises:

means for biasing said first element into an initial rest position, wherein said biasing means comprises a resilient element.

20. The apparatus defined by claim 19 wherein said second element comprises a stud guiding ramp extending in a direction substantially parallel to said first direction, wherein said ramp comprises said abutment surface, wherein said stud is positioned opposite from said abutment surface at said position.

21. The apparatus defined by claim 20 wherein said support comprises a cylindrical casing comprising:

an end wall comprising:

an internal face; and a diametral slot therein; and a casing cover comprising an internal wall, wherein said stud comprises a metal rod extending through said slot, wherein said stud further comprises a flat head, wherein said flat head abuts said internal wall of said casing cover when said stud is in said rest position, wherein said biasing means comprises a conical coil spring positioned between said flat head and said internal face of said end wall.

22. The apparatus defined by claim 20 wherein said stud guiding ramp comprises a lug projecting from the other of said components, wherein said projecting lug has the general shape of a curvilinear lozenge, wherein the major diagonal of said lozenge is substantially parallel to said first direction, wherein the ends of said major diagonal delimit first and second half-perimeters, wherein said stud follows said first half-perimeter in response to relative displacement of said components in said first direction, wherein said stud follows said second half-perimeter in response to relative displacement of said components in said second direction, wherein at least one of said half-perimeters comprises said abutment surface, wherein said abutment surface comprises a catch recess having a steep face in at least one of said half-perimeters.

23. The apparatus defined by 20 wherein said stud guiding ramp comprises spaced apart first and second ribs, wherein said stud engages said first rib before engaging said second rib in response to relative displacement of said components in said first direction, wherein said first rib is slightly inclined with respect to said first and second directions, wherein said first rib is sufficiently inclined with respect to said first and second directions so as to displace said stud away from said second rib in response to relative displacement of said components in said first direction, wherein said second rib extends substantially in the direction of said first and second directions, wherein said second rib comprises an end closest to said first rib, wherein said end of said second rib comprises said abutment surface, wherein the spacing of said first and second ribs at their nearest point is greater than the diameter of said stud.

24. The apparatus defined by claim 23 wherein each rib is parallelepipedal is shape.

25. The apparatus defined by claim 23 wherein each rib comprises a proximal end face facing the other rib, wherein said proximal end faces of said ribs are laterally offset with respect to each other.

26. The apparatus defined by claim 23 wherein said first and second ribs each comprises a lateral face having an end, wherein said first rib comprises:

means for engaging said stud with said lateral face of said first rib, thereby displacing said stud substantially perpendicular to said first direction away from said initial rest position in response to relative displacement of said components toward each other;

means for displacing said stud beyond said end of said lateral face of said first rib so as to disengaged said lateral face from said stud in response to further relative displacement of said components is said first direction;

wherein said biasing means comprises means for displacing said stud into contact with said lateral face of said second rib after said stud is displaced beyond said end of said lateral face of said first rib.

27. The apparatus defined by claim 26 wherein said second rib comprises:

an end face facing said first direction;

means for engaging said lateral face of said second rib with said stud in response to realtive displacement of said components in said second direction; and means for displacing said stud beyond said end of said lateral face of said second rib so as to disengage said lateral face of said second rib from said stud in response to further relative displacement of said components in said second direction, wherein said biasing means comprises means for displacing said stud to face said end face of said second rib after said stud is displaced beyond said end of said lateral face of said second rib so that relative displacement of said components in said first direction would cause said stud to abut said end face.

28. The apparatus defined by claim 1 in combination with an electric current supply connector, wherein said electric current supply connector comprises a male plug component comprising said male component and a female socket component comprising said female component, wherein said male and female components comprise contacts adapted to engage each other when said connector is closed and adapted to open and disengage from each other when said connector is opened, wherein said connector is adapted to be closed by a closing movement in said first direction so that said male and female components engage one another by relative translational and/or rotational displacement of said components, wherein said connector is adapted to be opened to separate said male and female components and to disengage and open said contacts from each other by relative displacement of said components in said second direction, wherein said apparatus comprises means for preventing displacement of said components in said first direction when said components are displaced relative to one another in said second direction a sufficient distance to open said contacts.

29. A method of connecting and disconneting two components comprising the steps of:

(a) displacing two components with respect to each other in a first direction;

(b) displacing a first element attached to one of said components in a direction substantially perpendicular to said first direction away from an initial rest position with a second element attached to said second component and extending substantially parallel to said first direction as a result of the further relative displacement of said two components in said first direction;

(c) displacing said first element toward said initial rest position as a result of the relative displacement of components in said first direction beyond the position of said components in step (b);

(d) displacing said two components with respect to each other in a second direction opposite from said first direction; and (e) preventing the displacement of said two components in said first direction after said two components are displaced in said second direction by a distance sufficient for an abutment surface on said second element to prevent displacement of said first element in said first direction.

30. The method defined by claim 28 wherein step (e) further comprises the step of positioning said first element into contact with said abutment surface, wherein said abutment surface extends substantially perpendicular to said first direction.

31. The method defined by claim 30 wherein said two components comprises a male component and a female component, wherein said method further comprises the steps of:

engaging said male and female components before step (a) by displacing said components in said first direction; and completely coupling said male and female components with each other between steps (c) and (d).

32. A method of connecting and disconnecting a male plug component and a female socket component of an electric current supply connector, wherein said components comprise electrical contacts adapted to engage ech other when said components are displaced in a first direction and adapted to disengage from each other when said components are displaced by a sufficient distance in a second direction, wherein said method comprises the steps of:

(a) engaging said male and female components and said electrical contacts by displacing said components in said first direction;

(b) displacing a first element attached to one of said components in a direction substantially perpendicular to said first direction away from an initial rest position with a second element attached to said second component and extending substantially parallel to said first direction as a result of the further relative displacement of said two components in said first direction;

(c) displacing said first element toward said initial rest position as s result of the relative displacement of components in said first direction beyond the position of said components in step (b);

(d) displacing said two components with respect to each other in said second direction opposite from said first direction; and (e) preventing the displacement of said components in said first direction when said components are displaced relative to one another in said second direction a sufficient distance to open said contacts.

* * * * *

UNITED STATES PATENT AND TRADEMARK OFFICE

CERTIFICATE OF CORRECTION

PATENT NO. : 4,732,567

DATED : March 22, 1988

INVENTOR(S) : Joseph CRESTIN

It is certified that error appears in the above-identified patent and that said Letters Patent is hereby corrected as shown below:

At column 1, line 44, change "explosuve" to ---explosive---.

At column 2, line 47, delete "of" after "embodiment".

At column 4, line 15, change "guding" to ---guiding---.

At column 4, line 31, change "is" to ---in---.

At column 4, line 44, change "is" to ---in---.

At column 4, line 36, change "wit" to ---with---.

At column 5, line 26, change "comonent" to ---component---.

At column 6, line 16, change "descriptin" to ---description---.

At column 6, line 23, delete "the" after "coupling of".

At column 6, line 26, change "perspectiv" to ---perspective---.

At column 8, line 21, change "throught" to ---through---.

At column 8, line 35, change "studs" to ---stud---.

At column 9, line 23, change "reveral" to ---reversal---.

At column 9, line 26, change "preent" to ---prevent---.

At column 10, line 12, change "extuds" to ---extends---.

At column 10, line 58, change "22" to ---25---.

At column 11, line 42, change "wherin" to ---wherein---.

At column 11, line 60, change "uncouplng" to ---uncoupling---.

At column 12, line 12, change "appartus" to ---apparatus---.

At column 12, line 54, delete "away".

At column 13, line 4, change "surfaces" to ---surface---.

At column 14, line 31, change "is" after "parallelepipedal" to ---in---.

At column 14, line 48, change "is" to ---in---.

At column 14 line 58, change "realtive" to ---relative---.

UNITED STATES PATENT AND TRADEMARK OFFICE

CERTIFICATE OF CORRECTION

PATENT NO. : 4,732,567

DATED : March 22, 1988

INVENTOR(S) : Joseph CRESTIN

It is certified that error appears in the above-identified patent and that said Letters Patent is hereby corrected as shown below:

At column 16, line 3, change "28" to ---29---.

Signed and Sealed this

Third Day of January, 1989

*Attest:*

DONALD J. QUIGG

*Attesting Officer*

*Commissioner of Patents and Trademarks*